United States Patent [19]

Kiya

[11] Patent Number: 4,990,965

[45] Date of Patent: Feb. 5, 1991

[54] IMAGE FORMING APPARATUS HAVING DUPLEX UNIT

[75] Inventor: Yukitoshi Kiya, Kawasaki, Japan

[73] Assignee: Ricoh Company, Ltd., Tokyo, Japan

[21] Appl. No.: 335,294

[22] Filed: Apr. 10, 1989

[30] Foreign Application Priority Data

| | | | |
|---|---|---|---|
| Apr. 15, 1988 | [JP] | Japan | 63-92958 |
| May 16, 1988 | [JP] | Japan | 63-116809 |
| Jan. 25, 1989 | [JP] | Japan | 1-15849 |

[51] Int. Cl.[5] ..... G03G 21/00

[52] U.S. Cl. ..... 355/319; 355/23; 271/186; 271/291; 271/202

[58] Field of Search ..... 355/319, 313, 23, 24, 355/318; 271/291, 186, 202

[56] References Cited

U.S. PATENT DOCUMENTS

| | | | |
|---|---|---|---|
| 4,468,114 | 8/1984 | Pels et al. | 355/24 X |
| 4,734,738 | 3/1988 | Yamanaka | 355/24 X |
| 4,772,917 | 9/1988 | Tani | 355/24 X |

*Primary Examiner*—R. L. Moses

*Attorney, Agent, or Firm*—Cooper & Dunham

[57] ABSTRACT

A duplex unit has a reversing part for reversing sides of recording sheets and a stack part for successively stacking the reversed recording sheets, where the stacked recording sheets are outputted in a first-in-first-out sequence. This duplex unit is suited for use on an image forming apparatus which records images on both sides of the recording sheets by an electrophotography.

12 Claims, 16 Drawing Sheets

IMAGE FORMING APPARATUS HAVING DUPLEX UNIT

BACKGROUND OF THE INVENTION

The present invention generally relates to duplex units and image forming apparatuses having a duplex unit, and more particularly to a duplex unit for reversing the side of a recording sheet and an image forming apparatus having such a duplex unit.

Recently, some image forming apparatuses such as laser printers, copying machines and facsimile machines are provided with a duplex unit which is used for reversing the side (or face) of a recording sheet so that an image can be formed on both sides of the recording sheet. In the laser printer, for example, the duplex unit is provided adjacent to a recording part and reverses the side of the recording sheet which has a first side already recorded with an image in the recording part so that the recording part can record an image on a second side of the recording sheet.

The duplex unit operates in a through mode or a stack mode. In the through mode, the duplex unit reverses the side of the recording sheets respectively recorded with an image on the first side thereof and successively supplies the reversed recording sheets to the recording part so that an image can be recorded on the second side of each of the recording sheets. On the other hand, in the stack mode, the duplex unit reverses the side of the recording sheets respectively recorded with an image on the first side thereof and stacks the reversed recording sheets. The stacked recording sheets are then successively supplied to the recording part so that an image can be recorded on the second side of each of the recording sheets.

The duplex unit which operates in the through mode has an advantage in that the recording speed (that is, the printing speed in the case of the printer) can be increased because the reversed recording sheets are continuously supplied to the recording part. However, there is a drawback in that the reversed recording sheets cannot be stopped temporarily during the duplex recording operation when it is necessary to wait for an image information to arrive from a controller. For this reason, there is a need from the practical point of view to provide a temporary stacking part in order to temporarily stack the reversed recording sheets, but this would increase both the overall size and production cost of the image forming apparatus.

The duplex unit which operates in the stack mode may be categorized into a serial stack type and a parallel stack type. In the serial stack type duplex unit which operates in the stack mode, the reversed recording sheets are stacked serially, that is, generally along the length of the recording sheets. Hence, there is a need to provide a transport path of a predetermined length to enable the serial stacking of the recording sheets. In addition, since the predetermined length is determined depending on a standard size (or maximum size) of the recording sheets, a space must be provided between a rear end of one recording sheet of the standard size and a front end of another recording sheet of a size smaller than the standard size. Such a space must be provided when recording sheets of different sizes are used simultaneously, and this space deteriorates the recording speed. Therefore, there is a limit to increasing the recording speed.

On the other hand, in the parallel stack type duplex unit which operates in the stack mode, the reversed recording sheets are stacked in parallel, that is, one on top of another. The stacked recording sheets are then successively supplied to the recording part in a sequence opposite to the stacking sequence. In other words, the recording sheets are successively supplied to the recording part from the top of the stack. For this reason, there is a need to provide a memory having a large memory capacity for storing at least two times a data quantity of the image data with respect to all of the recording sheets in the stack, and there is a drawback in that the image forming apparatus becomes expensive. Furthermore, because the last reversed recording sheet at the top of the stack must first be supplied to the recording part, there is a time loss between a time when the last reversed recording sheet is stacked and a time when the image is recorded on this last reversed recording sheet.

In most cases, the front end of the reversed recording sheet which has the image recorded on the first side thereof and is supplied from the duplex unit to the recording part for recording an image on the second side thereof corresponds to the rear end of the recording sheet before the side reversal. In other words, when recording the image on the second side of the recording sheet, the image data is supplied to the recording part in a reverse sequence to the recording sheet, that is, starting from the last line, so that the recording direction matches for the first and second sides of the recording sheet.

However, the recording sheet is heated when passing a fixing part and the recording sheet slightly shrinks when heated. When the recording is carried out on the second side of the reversed recording sheet which is still shrunk, the image on the second side becomes stretched compared to the image on the first side after the heated recording sheet returns to the normal state from the shrunk state. As a result, there are problems in that the starting or top positions of the images on the first and second sides differ and top margins (or blank portions) differ between the first and second sides of the recording sheet.

Conventionally, the front end of the recording sheet and the front end of the image are matched at the same position for both the first and second sides of the recording sheet. Hence, as shown in FIG. 1, a front end $2B_1$ of an image 2B on the second side of a recording sheet 2 and a rear end $2A_2$ of an image 2A on the first side of the recording sheet 2 are matched. In other words, end portions 2D of the images 2A and 2B are matched on the recording sheet 2. However, when the recording sheet is heated and shrunk, a front end $2A_1$ of the image 2A and a rear end $2B_2$ of the image 2B do not coincide on the recording sheet 2. That is, end portions 2C of the images 2A and 2B differ by a length L1 which corresponds to the shrinkage. The shrunk recording sheet 2 returns to the normal state after a sufficient time elapses, and there is a problem in that the image 2A becomes expanded compared to the image 2B and the problems described above occur.

It is conceivable to eliminate the above described problem by changing the transport speed of the recording sheet for the recording on the first side and the recording on the second side, or by changing a write clock signal which is used to control the recording timing so as to use different magnifications for the first and second sides. However, a complex circuitry is needed to take such conceivable measures, and the image forming apparatus will become considerably expensive.

SUMMARY OF THE INVENTION

Accordingly, it is a general object of the present invention to provide a novel and useful duplex unit and image forming apparatus in which the problems described above are eliminated.

Another and more specific object of the present invention is to provide a duplex unit which has a reversing part for reversing sides of recording sheets and a stack part for successively stacking the reversed recording sheets, where the stacked recording sheets are outputted in a first-in-first-out sequence. According to the duplex unit of the present invention, it is possible to output the reversed recording sheets at a high speed regardless of the sizes of the recording sheets used.

Still another object of the present invention is to provide a duplex unit of the above described type wherein the recording sheet is transported within the duplex unit at a transport speed dependent on a size of the recording sheet. According to the duplex unit of the present invention, it is possible to reverse the sides of the recording sheets and output the reversed recording sheets with a high efficiency independently of the sizes of the recording sheet.

A further object of the present invention is to provide an image forming apparatus including a duplex unit and a recording part. The duplex unit has a reversing part for reversing sides of recording sheets and a stack part for successively stacking the reversed recording sheets, and the stacked recording sheets are supplied to the recording part in a first-in-first-out sequence. According to the image forming apparatus of the present invention, it is possible to record images on the reversed recording sheets at a recording speed which is substantially the same as a recording speed for recording on only one side of each recording sheet. In addition, the duplex unit has a relatively simple construction which enables production at a low cost, thereby preventing a substantial increase in the cost of the image forming apparatus.

Another object of the present invention is to provide an image forming apparatus which has a feeding part for feeding the recording sheets to the recording part, and the feeding part feeds the reversed recording sheets to the recording part with a timing delayed with respect to a timing with which the recording sheets before the side reversal are fed to the recording part. According to the image forming apparatus of the present invention, it is possible to match starting or top positions of the images on the two sides of the recording sheet and make top margins (or blank portions) the same on the two sides of the recording sheet, regardless of the shrinkage of the recording sheet which occurs when heated during the recording.

Still another object of the present invention is to provide an image forming apparatus of either one of the above described types wherein the recording sheet is transported within the duplex unit at a transport speed dependent on a size of the recording sheet. According to the image forming apparatus of the present invention, it is possible to carry out the so-called duplex recording on the recording sheets (that is, recording images on both sides of the recording sheets) with a high efficiency independently of the sizes of the recording sheet.

Other objects and further features of the present invention will be apparent from the following detailed description when read in conjunction with the accompanying drawings.

DETAILED DESCRIPTION

Figure 2:
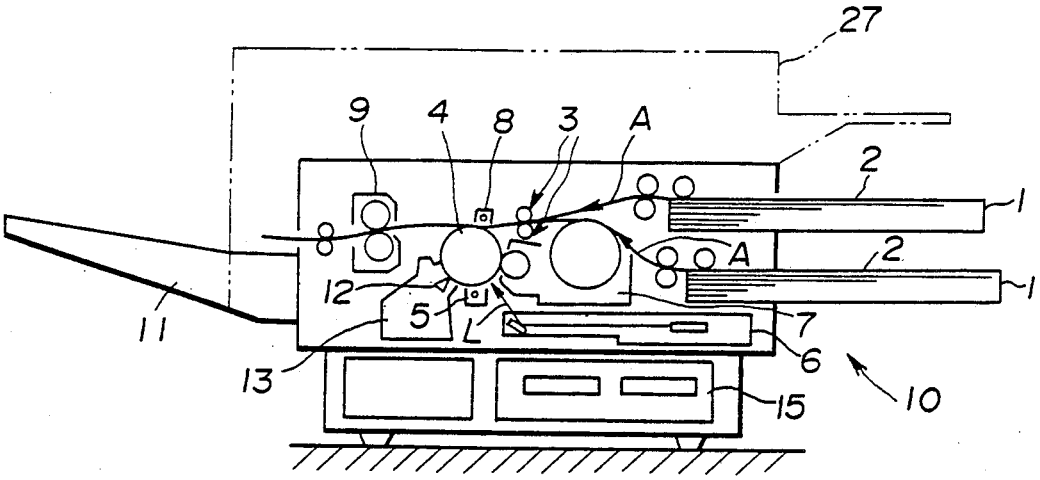
FIG. 2 is a cross sectional view generally showing a first embodiment of an image forming apparatus according to the present invention.
Figure 4:
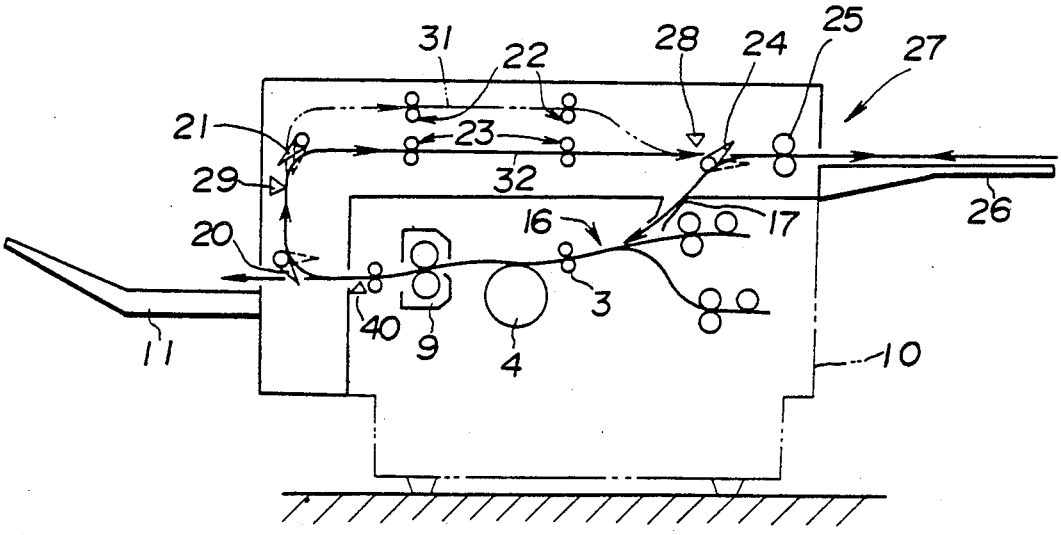
FIG. 4 is a cross sectional view generally showing an essential part of a duplex unit together with essential related parts of the main printer body of the first embodiment.
Figure 3:
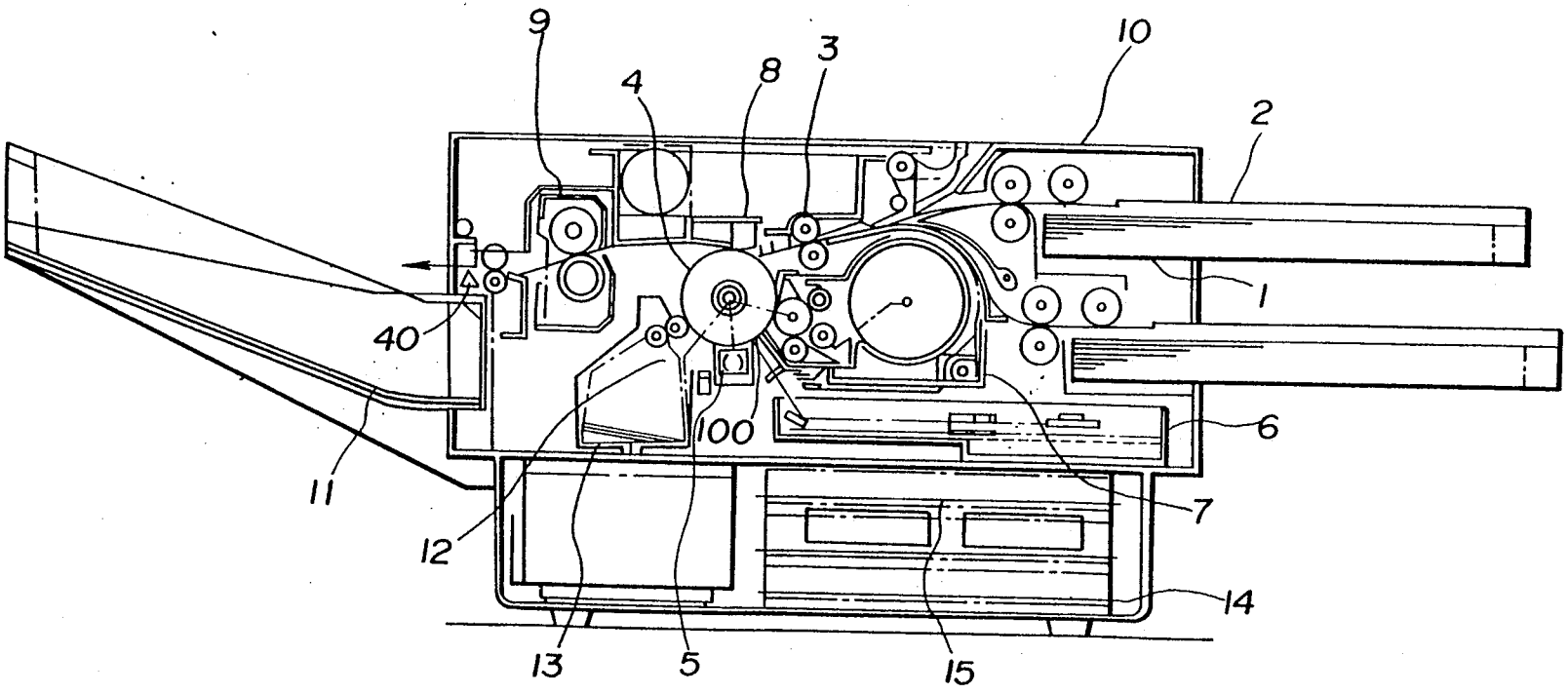
FIG. 3 is a cross sectional view showing an essential part of a main printer body of the first embodiment.

FIG. 2 generally shows a first embodiment of an image forming apparatus according to the present invention, FIG. 3 shows an essential part of a main printer body of this embodiment, and FIG. 4 shows essential rollers, sensors and the like of this embodiment. In FIGS. 2 through 4, a recording sheet 2 supplied in a direction A from a paper supplying device 1 is transported to a photosensitive body 4 through a resist roller pair 3 which determines a timing with which the recording sheet 2 is supplied to the photosensitive body 4. In this embodiment, the photosensitive body 4 is a photosensitive drum. A resist sensor 16 is located in a vicinity of the resist roller pair 3 on the side of the paper supplying device 1.

A surface of the photosensitive body 4 is charged by a charger 5 while the photosensitive body 4 is rotated counterclockwise. A laser beam L emitted from a laser optical system 6 is irradiated on the charged surface of the photosensitive body 4 to form an electrostatic image thereon. The electrostatic image is visualized into a toner image by a developing unit 7, and the toner image is transferred onto the recording sheet 2 by a transfer charger 8. The toner image transferred on the recording sheet 2 is fixed by a fixing unit 9. The recording sheet 2 which is outputted from the fixing unit 9 is ejected towards an ejection part (or ejection tray) 11. The photosensitive body 4, the charger 5, the laser optical system 6, the developing unit 7, the transfer charger 8 and the fixing unit 9 constitute a recording part of the image forming apparatus.

On the other hand, the surface of the photosensitive body 4 after the toner image is transferred onto the recording sheet 2 is cleaned by a cleaning unit having cleaning blades 12 so as to remove the residual toner. The removed residual toner is recovered into a toner recovery tank 13.

A controller 14 and a printer control part 15 for controlling various parts of the image forming apparatus are provided at a bottom portion of a main printer body 10.

The recording sheet 2 which is ejected from the main printer body 10 is supplied to a duplex unit 27 indicated by a phantom line in FIG. 2. The main printer body 10 and the duplex unit 27 constitute the image forming apparatus.

An essential part of the duplex unit 27 is shown in FIG. 4 together with essential related parts of the main printer body 10. A recording sheet #1 which has an image recorded on a first side thereof and is ejected first from the main printer body 10 is directed upwardly by a switch claw 20 and is transported to a lower transport path 32 of a stack part by a switch claw 21. The recording sheet #1 is transported towards rollers 25 by lower transport rollers 23 and is supplied to a switchback tray 26 by the rollers 25 which rotate in forward directions. Hereunder, the recording sheets 2 which are successively supplied from the paper supplying device 1 are referred to as recording sheets #1, #2, #3, . . . #n in a sequence with which these recording sheets are supplied.

When a rear end of the recording sheet #1 is detected by a transport path sensor 28 and a predetermined time elapses thereafter, a switch claw 24 in a horizontal position switches to a position where a tip end of the switch claw 24 points to an upper right direction of the duplex unit 27. At the approximately same time, the rollers 25 rotate in reverse directions for a predetermined time so as to move the recording sheet #1 toward an entrance 17 of the main printer body 10. The rollers 25 stop rotating in the reverse directions when a front end of the recording sheet #1 reaches a tip end of the entrance 17 and the recording sheet #1 waits at the tip end of the entrance 17.

The recording sheet #2 which is supplied second from the paper supplying device 1 has an image recorded on a first side thereof and is ejected second from the main printer body 10. The recording sheet #2 passes by the switch claws 20 and 21 and is transported to the lower transport path 32 of the stack part. When a rear end of the recording sheet #2 is detected by an entrance sensor 29, the transport of the recording sheet #2 is stopped after a predetermined time so that the recording sheet #2 is stacked in the lower transport path 32.

Figure 5:
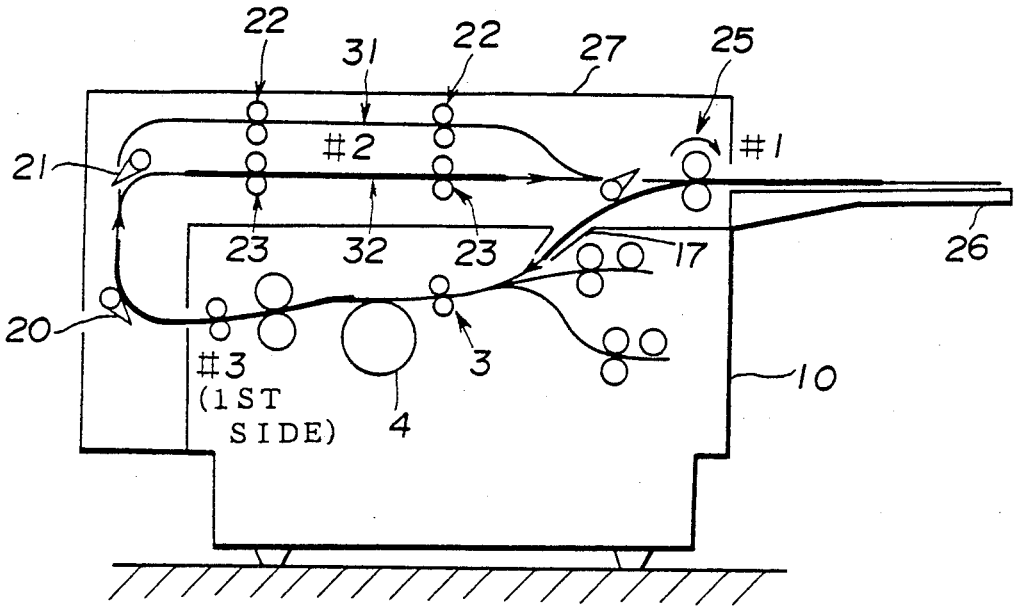
FIGS. 5 through 9 are cross sectional views respectively showing locations of recording sheets at various operation stages of the image forming apparatus.

The recording sheet #3 which is supplied third from the paper supplying device 1 has an image recorded on a first side thereof and is ejected third from the main printer body 10. The recording sheet #3 is directed upwardly by the switch claw 20. In this state, the recording sheets #1, #2 and #3 are located at positions indicated by bold lines in FIG. 5. As shown in FIG. 5, the recording sheet #1 waits at the tip end of the entrance 7 and the recording sheet #2 is stacked in the lower transport path 32 when the image recording on the first side of the recording sheet #3 is completed and the recording sheet #3 is ejected to the duplex unit 27.

Thereafter, the recording sheet #3 is directed upwardly by the switch claw 21 and is supplied to to an upper transport path 31 of the stack part by transport rollers 22. As in the case of the recording sheet #2, a rear end of the recording sheet #3 is detected by the entrance sensor 29 and the recording sheet #3 is stacked in the upper transport path 31.

The recording sheet #1 in the waiting position at the tip end of the entrance 17 is supplied to the resist roller pair 3 within the main printer body 10 by the rollers 25 in synchronism with the operation of transporting the recording sheet #3 to the upper transport path 31. Hence, the image recording on the second side of the recording sheet #1 is carried out by the photosensitive body 4.

Figure 6:
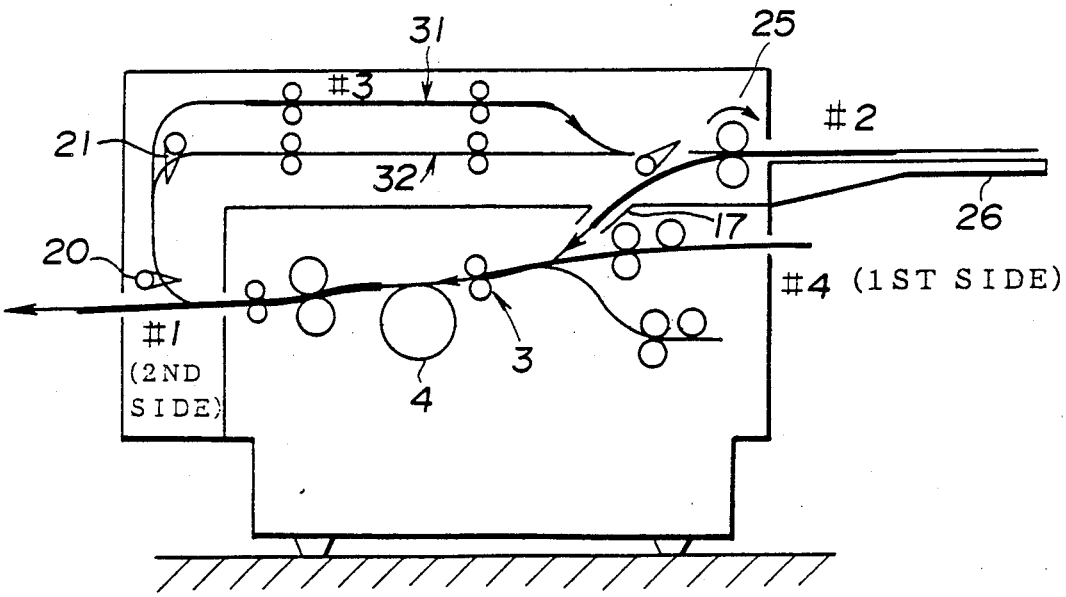

After the image recording on the second side of the recording sheet #1 is completed, the recording sheet #4 is immediately supplied from the paper supplying device 1 so as to carry out the image recording on the first side of the recording sheet #4. In addition, the recording sheet #2 stacked in the lower transport path 32 is supplied to the switchback tray 26 by the rollers 23 and 25 in synchronism with the operation of carrying out the image recording on the first side of the recording sheet #4. Hence, as in the case of the recording sheet #1, the recording sheet #2 is switched back and waits at the tip end of the entrance 18. FIG. 6 shows the locations of the recording sheets #1, #2, #3 and #4 in this state. As shown in FIG. 6, at a time when the image recording on the second side of the recording sheet #1 is completed and the image recording on the first side of the recording sheet #4 is carried out, the recording sheet #2 waits at the tip end of the entrance 17 and the recording sheet #3 is stacked in the upper transport path 31.

The recording sheet #1 having the images recorded on both the first and second sides thereof is then ejected approximately horizontally by the switch claw 20. Thus, the recording sheet #1 is supplied to the ejection part 11 and stacked.

Figure 7:
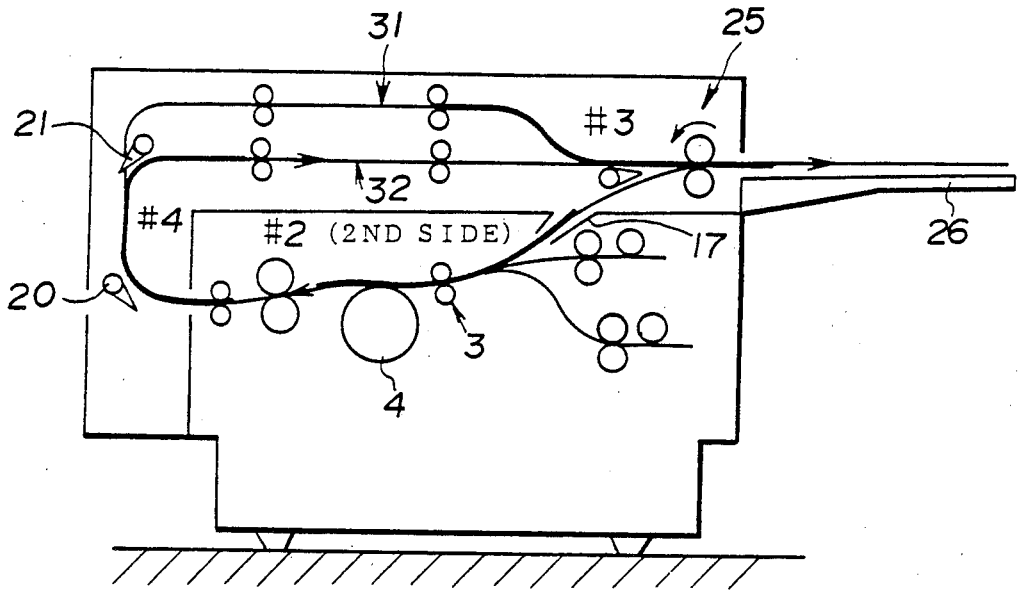
Figure 8:
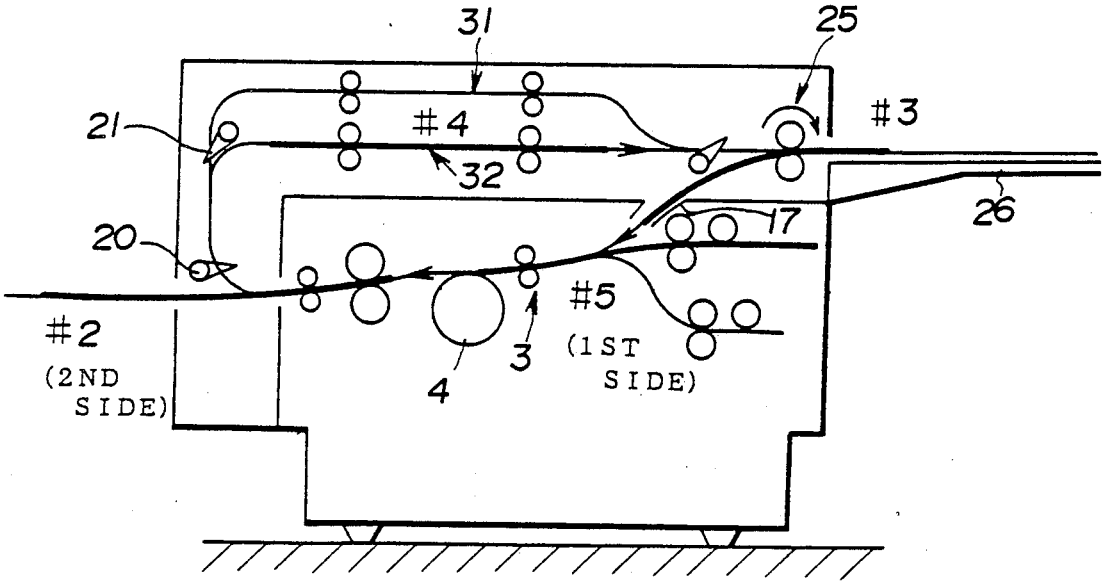

Then, the recording sheet #4 having the image recorded on the first side thereof is directed towards the lower transport path 32 by the switch claws 20 and 21. The recording sheet #2 in the waiting position at the tip end of the entrance 17 is fed to the photosensitive body 4 by the resist roller pair 3 and the image recording is carried out on the second side of the recording sheet #2. In synchronism with these movements of the recording sheets #4 and #2, the recording sheet #3 stacked in the upper transport path 31 is supplied to the switchback tray 26 by the rollers 25 as shown in FIG. 7.

When the image recording on the second side of the recording sheet #2 is completed, the recording sheet #5 is immediately supplied from the paper supplying device 1 so as to carry out the image recording on the first side of the recording sheet #5. In addition, the recording sheet #3 stacked in the lower transport path 32 is supplied to the switchback tray 26 by the rollers 23 and 25 in synchronism with the operation of carrying out the image recording on the first side of the recording sheet #5. Hence, the recording sheet #3 is switched back and waits at the tip end of the entrance 18. FIG. 7 shows the locations of the recording sheets #2, #3, #4 and #5 in this state. As shown in FIG. 7, at a time when the image recording on the second side of the recording sheet #2 is completed and the image recording on the first side of the recording sheet #5 is carried out, the recording sheet #3 waits at the tip end of the entrance 17 and the recording sheet #4 is stacked in the lower transport path 32.

The recording sheet #2 having the images recorded on both the first and second sides thereof is then ejected approximately horizontally by the switch claw 20. Thus, the recording sheet #2 is supplied to the ejection part 11 and stacked.

Accordingly, the image recording on the first side of each of the recording sheets, the stacking of the recording sheets and the image recording on the second side of each of the recording sheets are successively repeated in the following sequence. That is, the image recording is carried out in the sequence of the first sides of the recording sheets #1, #2 and #3, the second side of the recording sheet #1, the first side of the recording sheet #4, the second side of the recording sheet #2, the first side of the recording sheet #5, the second side of the recording sheet #3, . . . , the first side of the recording sheet #n, the second side of the recording sheet #(n−2), . . . .

Figure 9:
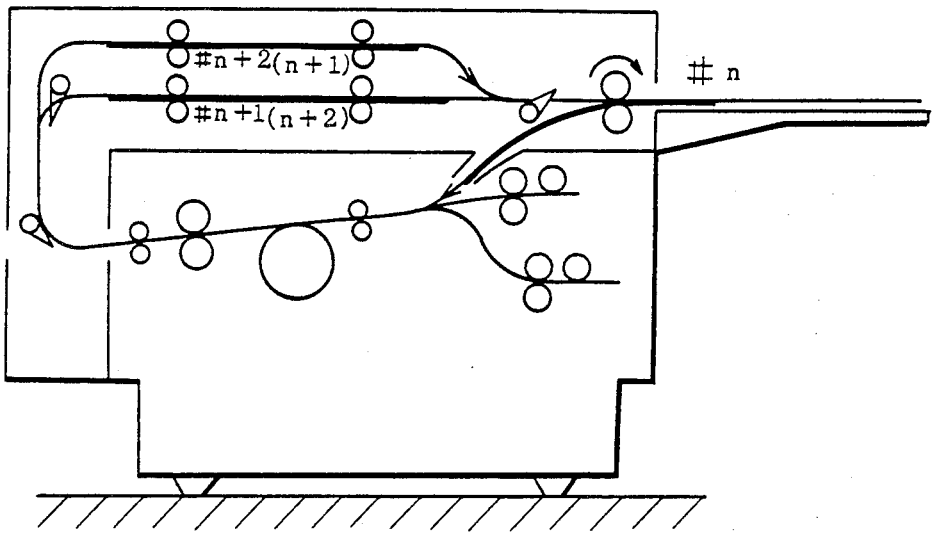

The image recording on the first and second sides of the recording sheets 2 are respectively started when image data are obtainable from the controller 15 shown in FIGS. 2 and 3. When the image data of the image to be recorded on the second side of the recording sheet #n is delayed for some reason, the recording sheets #(n+1) and #(n+2) respectively wait in the transport paths 32 and 31 as shown in FIG. 9.

The recording sheets 2 having the images recorded on the first sides thereof are alternately supplied to the lower and upper transport paths 32 and 31 and stacked not serially but in parallel. For this reason, even when the sizes of the recording sheets 2 differ, no space is wasted between the stacked recording sheets 2 as in the case where the recording sheets are stacked serially. Thus, the recording speed can be increased even when the recording sheets 2 of different sizes are used. In addition, there is no time loss when carrying out the image recording on the second sides of the stacked recording sheets 2 because the image recording on the second sides of the recording sheets 2 is carried out in the sequence in which the recording sheets 2 are stacked. In other words, the recording sheets 2 are supplied to and outputted from the stack part according to the first-in-first-out sequence. Therefore, it is possible to record the images on the second sides of the recording sheets 2 at a recording speed which is substantially the same as a recording speed for recording the image on only one side of the recording sheets 2.

Furthermore, since the image recording on the second sides of the recording sheets 2 is carried out in the sequence in which the recording sheets 2 are stacked, a memory for temporarily storing the image data does not need a large memory capacity, thereby making it possible to reduce the cost of the image forming apparatus.

In this embodiment, the stack part has two stacking stages which are the upper and lower transport paths 31 and 32, but the stack part may have three or more stacking stages. Furthermore, it is of course possible to stack two or more recording sheets 2 in one stage of the stack part.

In addition, the recording sheets #(n+1) and #(n+2) are respectively stacked in the transport paths 32 and 31, but it is of course possible to stack the recording sheets #(n+1) and #(n+2) respectively in the transport paths 31 and 32.

Figure 10:
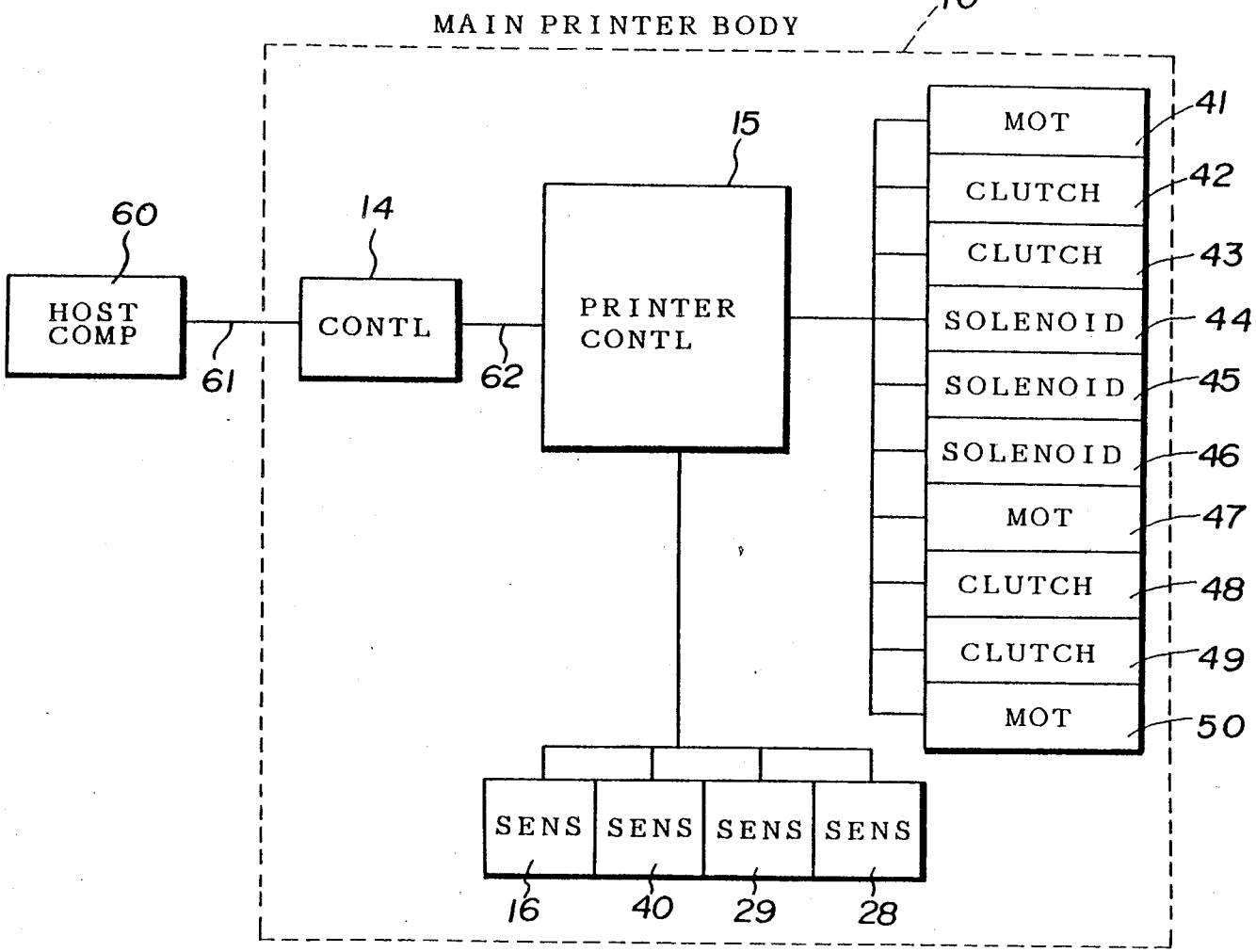
FIG. 10 is a system block diagram showing an electrical system of the main printer body.

FIG. 10 shows an electrical system of the main printer body 10. The main printer body 10 includes the controller 14 which is coupled to an external host computer 60 through a host interface 61, the printer control part 15 which is coupled to the controller 14 through a video interface 62, the sensors 16, 40, 29 and 28, motors 41, 47 and 50, clutches 42, 43, 48 and 49, and solenoids 44, 45 and 46. The motor 41 drives the paper supplying device 1 and the resist roller pair 3 through the respective clutches 42 and 43. The solenoids 44, 45 and 46 respectively drive the switch claws 20, 21 and 24. The motor 47 drives the transport rollers 22 and 23 through the respective clutches 48 and 49. The motor 50 drives the rollers 25. The operation of the motors 41, 47 and 50, the clutches 42, 43, 48 and 49, and the solenoids 44, 45 and 46 are controlled by the the printer control part 15 which is made up of a central processing unit (CPU), for example, responsive to the output signals of the sensors 16, 40, 29 and 28.

For convenience' sake, a description will now be given on the operation of the electrical system shown in FIG. 10 for a case where print data amounting to 8 pages of images are supplied to the main printer body 10 from the host computer 60. In this case, the print data from the host computer 60 is supplied to the controller 14 through the host interface 61 from page 1 to page 8. The controller 14 converts the print data into image data having a format suited for the image recording in the main printer body 10, and in this case, the print data are converted in the sequence of the pages 2-4-6-1-8-3-5-7. Every time one page of the print data is converted into the image data, the controller 14 supplies a paper supplying position and a paper ejecting position selection command to the printer control part 15 through the video interface 62 in accordance with the following Table together with a print start command.

TABLE

| Converting Page | Paper Supplying Position | Paper Ejecting Position | Selection Command |
|---|---|---|---|
| 2 | Device 1 | Unit 27 | C1 |
| 4 | Device 1 | Unit 27 | C2 |
| 6 | Device 1 | Unit 27 | C3 |
| 1 | Unit 27 | Part 11 | C4 |
| 8 | Device 1 | Unit 27 | C5 |
| 3 | Unit 27 | Part 11 | C6 |
| 5 | Unit 27 | Part 11 | C7 |
| 7 | Unit 27 | Part 11 | C8 |

The printer control part 15 which receives the paper supplying position and paper ejecting position selection command and the print start command carries out the following control. When supplying the recording sheet 2 from the paper supplying device 1, the printer control part 15 turns ON the motor 41 and the clutch 42 so as to start supplying the recording paper 2 from the paper supplying device 1 to the resist roller pair 3. When supplying the recording sheet 2 from the duplex unit 27, the printer control part 15 rotates the motor 50 in a reverse direction so as to supply the recording sheet 2 from the duplex unit 27 to the resist roller pair 3. On the other hand, when ejecting the recording sheet 2 to the duplex unit 27, the printer control part 15 turns ON the solenoid 44 when the recording sheet 2 is detected by the paper eject sensor 40 so as to supply the recording sheet 2 to the duplex unit 27. When ejecting the recording sheet 2 to the ejection part 11, the printer control part 15 turns OFF the solenoid 44 when the recording sheet 2 is detected by the paper eject sensor 40 so as to supply the recording sheet 2 to the ejection part 11.

Figure 11:
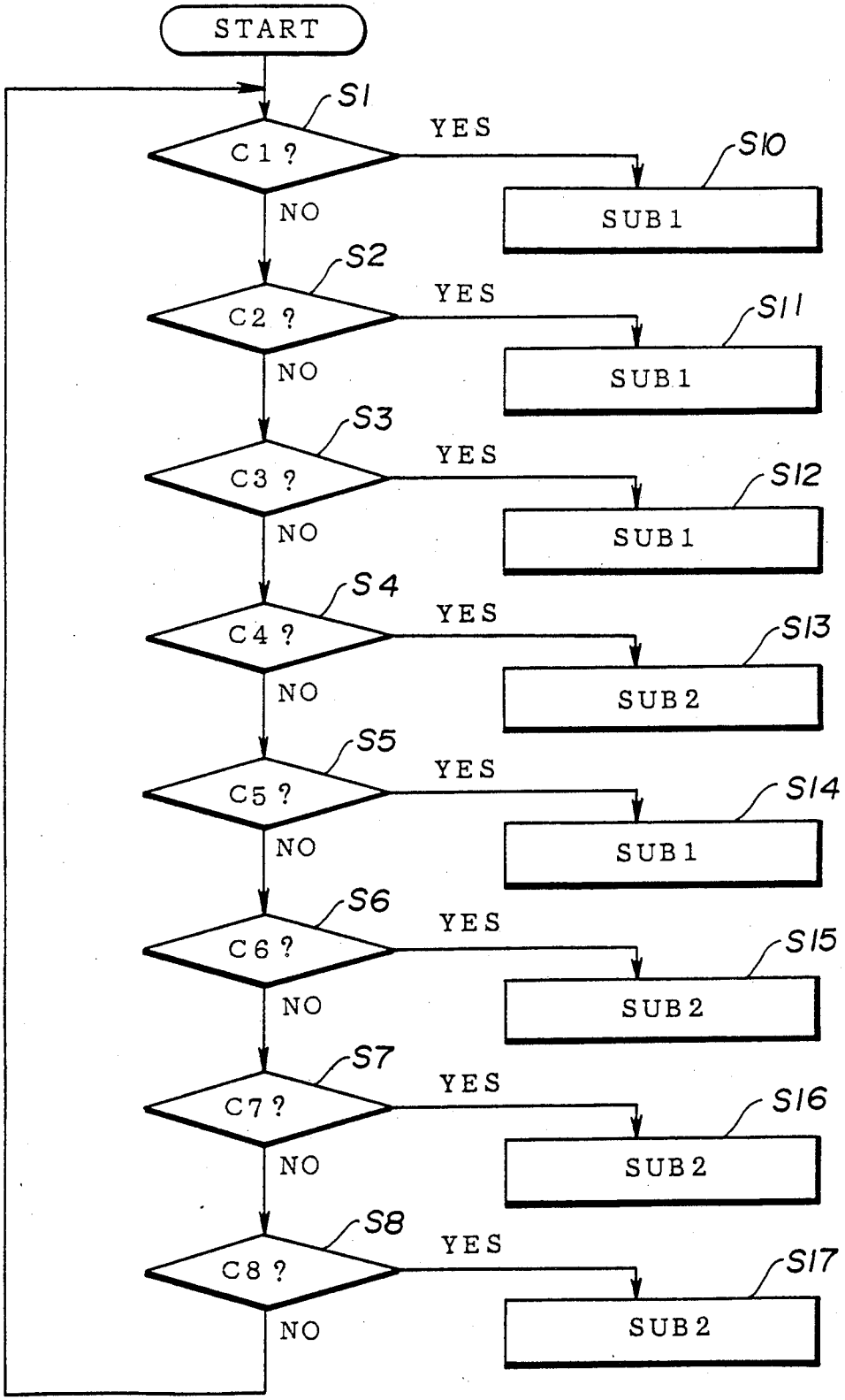
FIG. 11 is a flow chart for explaining an operation of a printer control part of the main printer body for the first embodiment.

FIG. 11 shows an operation of the printer control part 15 responsive to the selection command received from the controller 14. Steps S1 through S8 respectively discriminate whether the selection commands C1 through C8 are received from the controller 14. When the discrimination result in the step S1, S2, S3 or S5 is YES, a corresponding one of steps S10, S11, S12 and S14 carries out a first subroutine SUB1 so as to supply the recording sheet 2 from the paper supplying device 1 to the duplex unit 27. When the discrimination result in the step S4, S6, S7 or S8 is YES, a corresponding one of steps S13, S15, S16 and S17 carries out a second subroutine SUB2 so as to supply the recording sheet 2 from the duplex unit 27 and eject the recording sheet 2 onto the ejection part 11. In this case, the subroutines SUB1 and/or SUB2 with respect to each of the commands C1 through C8 are carried out in parallel. In other words, a plurality of the subroutines are carried out simultaneously until all of these subroutines end.

Figure 12A:
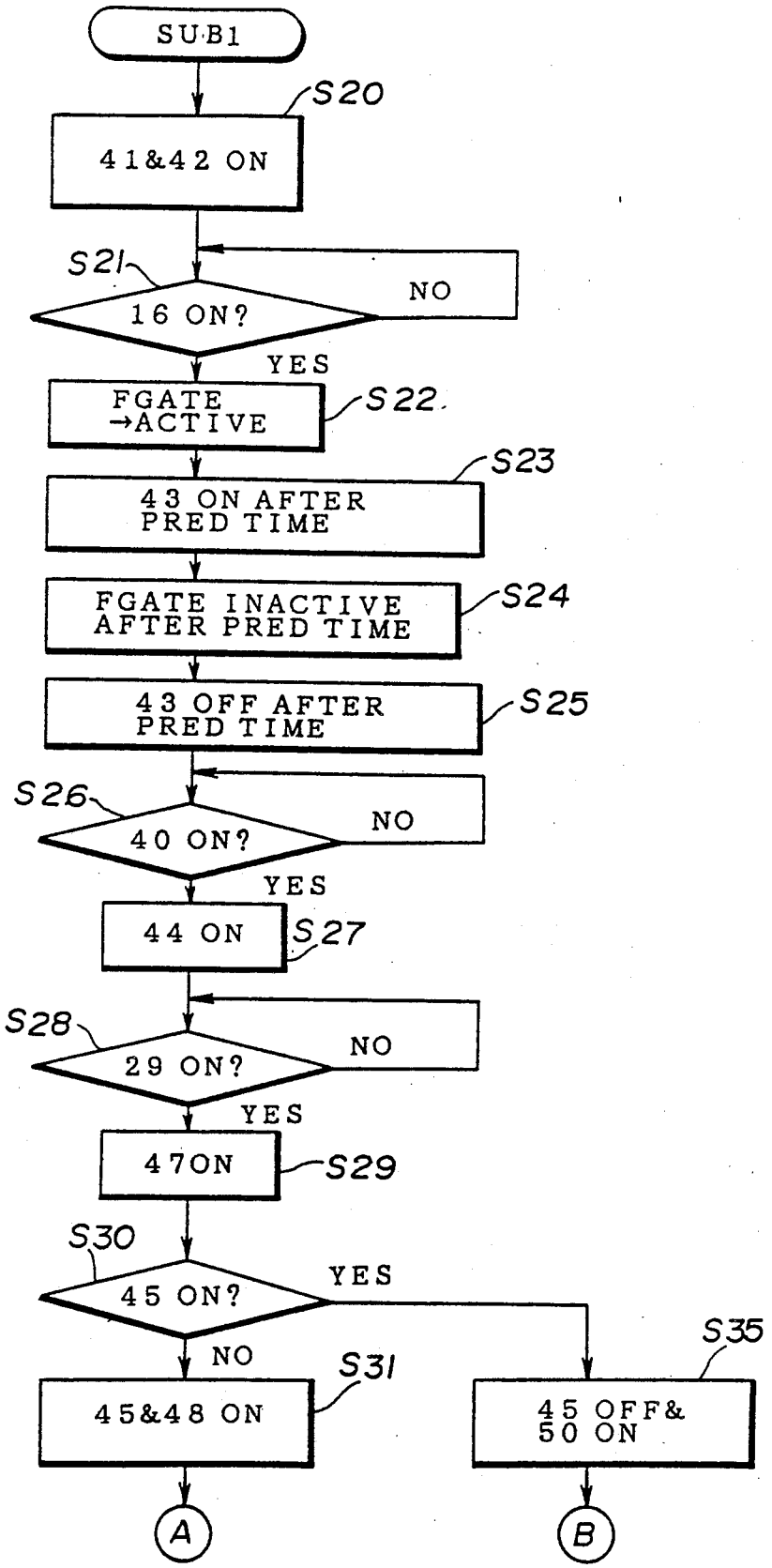
FIGS. 12A and 12B are flow charts for explaining a first subroutine of the printer control part.
Figure 12B:
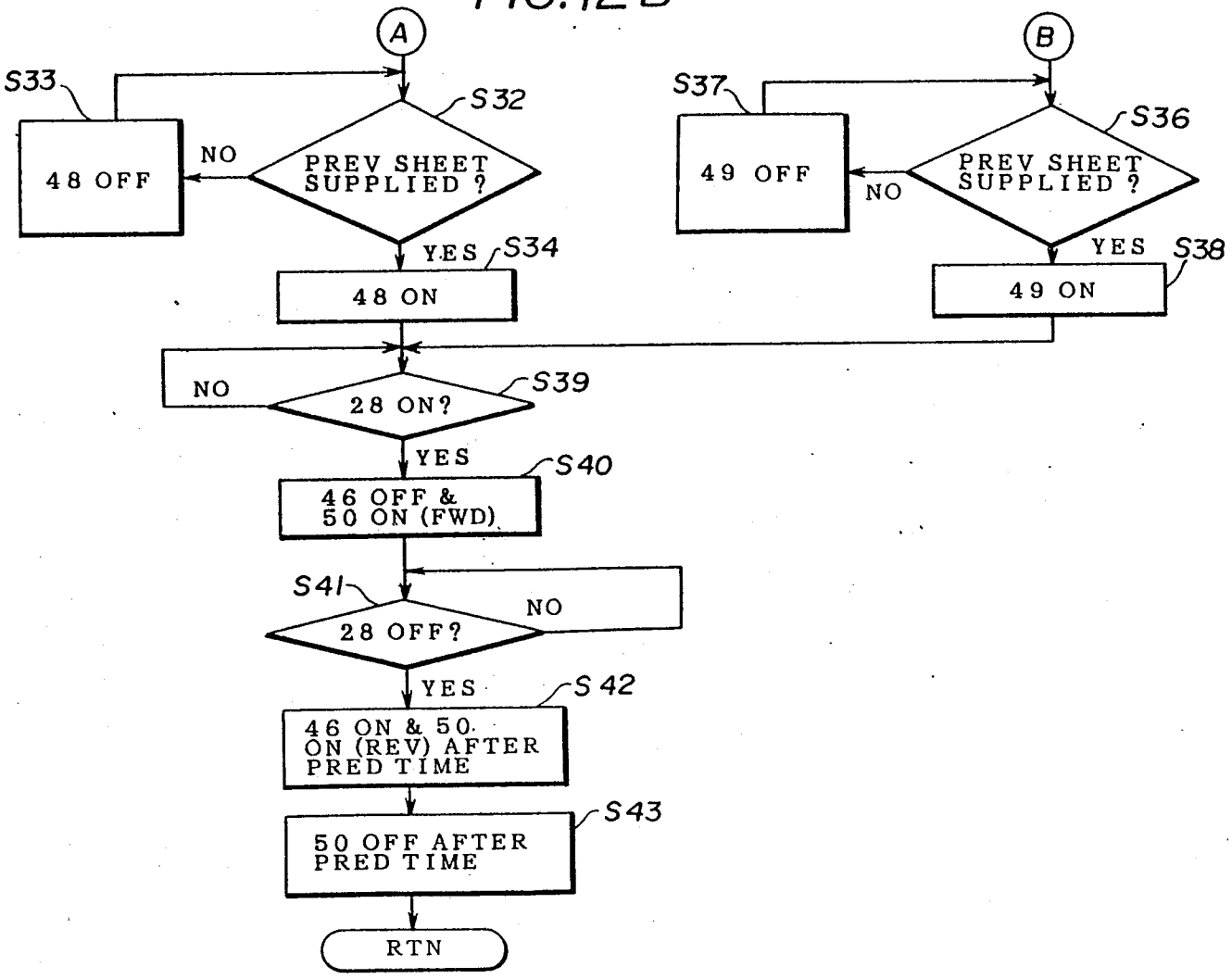

FIGS. 12A and 12B show flow charts for explaining the first subroutine SUB1. In FIG. 12A, a step S20 turns ON the motor 41 and the clutch 42. A step S21 discriminates whether or not the resist sensor 16 is ON. When the discrimination result in the step S21 becomes YES, a step S22 makes active an image write signal FGATE which indicates an effective range in a sub scanning direction for recording the image. A step S23 turns the clutch 43 ON after a predetermined time elapses from a time when the image write signal FGATE becomes active. A step S24 makes the image write signal FGATE inactive after a predetermined time elapses from a time when the clutch 43 turns ON. In addition, a step S25 turns the clutch 43 OFF after a predetermined time elapses from a time when the image write signal FGATE becomes inactive.

A step S26 discriminates whether or not the paper eject sensor 40 is ON. When the discrimination result in the step S26 becomes YES, a step S27 turns ON the solenoid 44 and switches the switch claw 20 to such a position that the recording sheet 2 is directed towards the duplex unit 27. Then, a step S28 discriminates whether or not the entrance sensor 29 is ON. When the discrimination result in the step S28 becomes YES, a step S29 turns ON the motor 47 and a step S30 discriminates whether or not the solenoid 45 is ON. When the discrimination result in the step S30 is NO, a step S31 turns ON the solenoid 45 and the clutch 48 and the process advances to a step S32 shown in FIG. 12B. On the other hand, when the discrimination result in the step S30 is YES, a step S35 turns OFF the solenoid 45 and turns ON the clutch 49 and the process advances to a step S36 shown in FIG. 12B.

The step S32 shown in FIG. 12B discriminates whether or not a previously supplied recording sheet 2 is reversed and supplied again from the rollers 25. When the discrimination result in the step S32 is NO, a step S33 turns OFF the clutch 48 so as to temporarily stop the recording sheet 2 in the upper transport path 31 at a position prior to the transport path sensor 28 until all of the previously supplied recording sheet 2 is supplied from the rollers 25. A step S34 turns ON the clutch 48 to supply the recording sheet 2 to the rollers 25 when the discrimination result in the step S32 becomes YES.

The step S36 shown in FIG. 12B discriminates whether or not a previously supplied recording sheet 2 is reversed and supplied again from the rollers 25. When the discrimination result in the step S32 is NO, a step S37 turns OFF the clutch 49 so as to temporarily stop the recording sheet 2 in the lower transport path 32 at a position prior to the transport path sensor 28 until all of the previously supplied recording sheet 2 is supplied from the rollers 25. A step S38 turns ON the clutch 49 to supply the recording sheet 2 to the rollers 25 when the discrimination result in the step S36 becomes YES.

After the step S34 or S38, a step S39 discriminates whether or not the transport path sensor 28 is ON. When the discrimination result in the step S39 becomes YES, a step S40 turns OFF the solenoid 46 and rotates the motor 50 in the forward direction so that the recording sheet 2 is supplied to the rollers 25 through the switch claw 24. A step S41 discriminates whether or not the transport path sensor 28 is OFF. After a predetermined time elapses from a time when the discrimination result in the step S41 becomes YES, a step S42 turns ON the solenoid 46 and rotates the motor 50 in the reverse direction so as to start the reversal operation. A step S43 turns OFF the motor 50 after a predetermined time elapses from a time when the solenoid 46 and the motor 50 are turned ON, and the process returns to the main routine.

Figure 13:
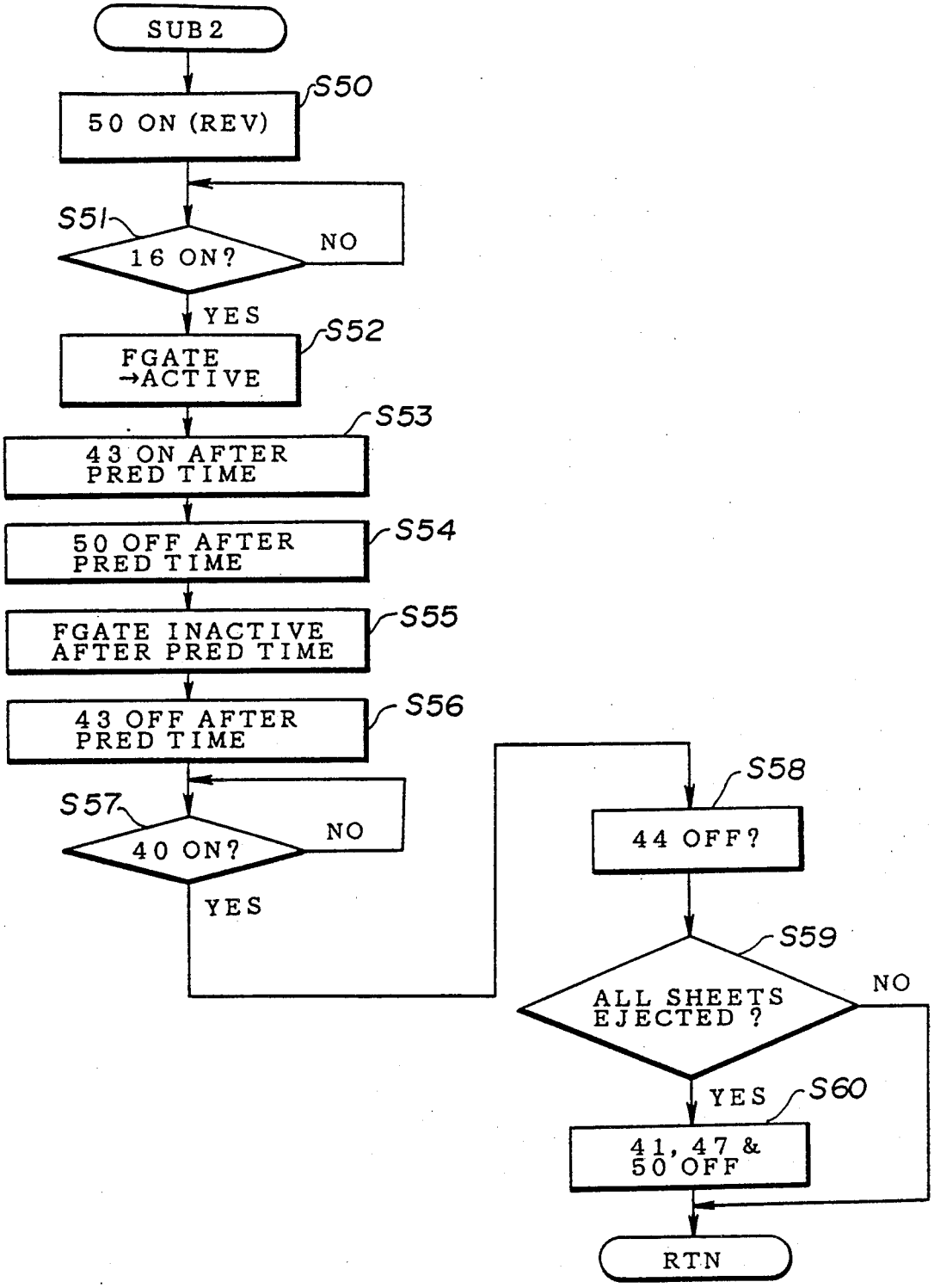
FIG. 13 is a flow chart for explaining a second subroutine of the printer control part.

FIG. 13 shows a flow chart for explaining the second subroutine SUB2. In FIG. 13, a step S50 turns ON the motor 50, and a step S51 discriminates whether or not the resist sensor 16 is ON. When the discrimination result in the step S51 becomes YES, a step S52 makes the image write signal FGATE active. A step S53 turns the clutch 43 ON after a predetermined time elapses from a time when the image write signal FGATE becomes active. A step S54 turns OFF the motor 50 after a predetermined time elapses from a time when the image write signal FGATE becomes active. A step S56 makes the image write signal FGATE inactive after a predetermined time elapses from a time when the motor 50 is turned OFF. In addition, a step S56 turns OFF the clutch 43 after a predetermined elapses from a time when the image write signal FGATE becomes inactive.

A step S57 discriminates whether or not the paper eject sensor 40 is ON. When the discrimination result in the step S57 becomes YES, a step S58 turns OFF the solenoid 44 so that the recording sheet 2 is ejected to the ejection part 11 through the switch claw 20. A step S59 discriminates whether or not all of the recording sheets 2 within the image forming apparatus are ejected to the ejection part 11. When the discrimination result in the step S59 is YES, a step S60 turns OFF the motors 41, 47 and 50 and the process returns to the main routine to prepare for the next recording operation. The process also returns to the main routine when the discrimination result in the step S59 is NO.

In the described embodiment, the printer control part 15 controls the operations of both the main printer body 10 and the duplex unit 27. In other words, a single CPU controls both the main printer body 10 and the duplex unit 27. However, it is of course possible to provide two CPUs and use these two CPUs to respectively control the operations of the main printer body 10 and the duplex unit 27.

Figure 14:
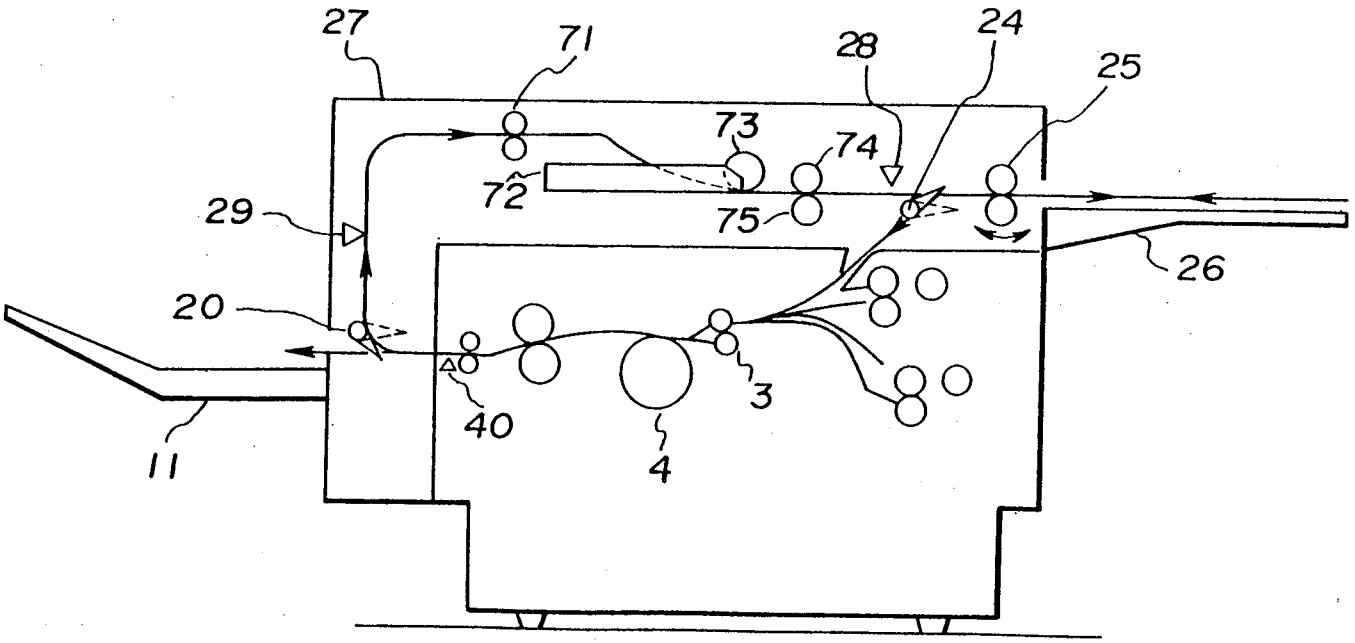
FIG. 14 is a cross sectional view generally showing an essential part of a second embodiment of the image forming apparatus according to the present invention.

Next, a description will be given of a second embodiment of the image forming apparatus according to the present invention, by referring to FIG. 14. In FIG. 14, only the essential parts of the second embodiment are shown, and those parts which are substantially the same as those corresponding parts in FIGS. 2 through 4 are designated by the same reference numerals and a description thereof will be omitted.

In this embodiment, a stack part has transport rollers 71, a stacking tray 72, sponge rollers 73, separation rollers 74 and duplex supply rollers 75. An arbitrary number of recording sheets 2 can be stacked on the stacking tray 72, and the recording sheets 2 are supplied to and outputted from the stack part according to the first-in-first-out sequence similarly as in the case of an automatic document feeder of a facsimile machine or a copying machine. Hence, the recording sheets 2 are stacked one on top of another on the stacking tray 72 and the recording sheet 2 at the bottom of the stack is separated by the separation rollers 74 and supplied to the switchback tray 26 by the duplex supply rollers 75 by way of the switch claw 24 and the rollers 25. According to this embodiment, it is possible to reduce the size of the stack part especially when compared to the first embodiment having a large number of stacking stages (or transport paths).

Figure 15:
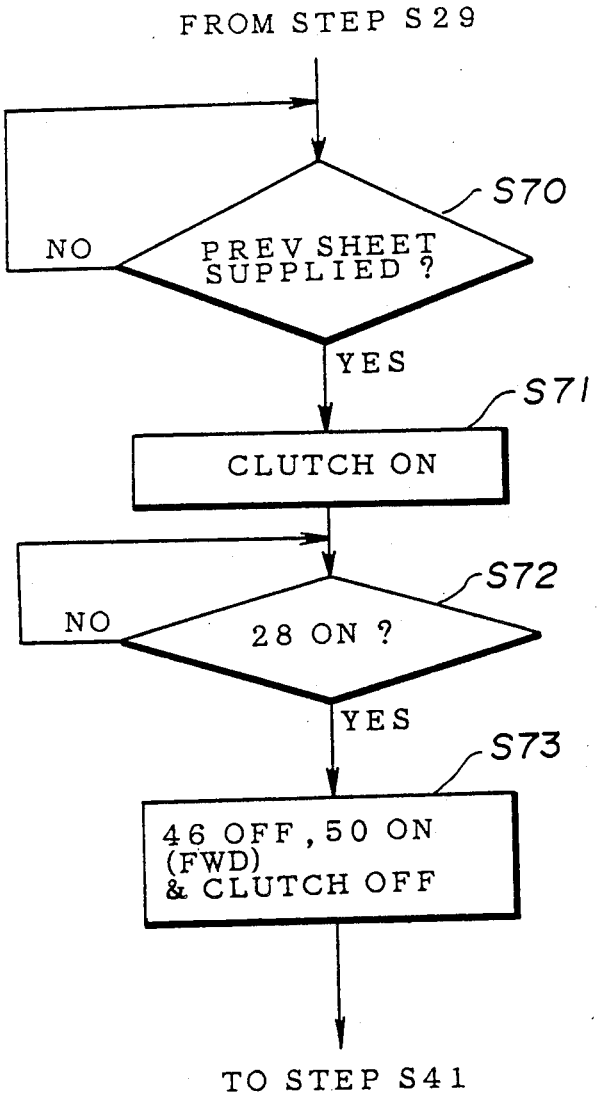
FIG. 15 is a flow chart for explaining an essential part of the first subroutine of the printer control part for the second embodiment.

According to this embodiment, the subroutine SUBl carried out by the printer control part 15 slightly differs from the flow charts shown in FIGS. 12A and 12B and steps S70 through S72 shown in FIG. 15 are carried out in place of the steps S30 through S40. In FIG. 15, a step S70 discriminates whether or not all of the previously supplied recording sheet 2 is supplied from the rollers 25. When the discrimination result in the step S70 becomes YES, a step S71 turns ON a clutch (not shown) which drives the duplex supply rollers 75 so as to supply the recording sheet 2 at the bottom of the stack towards the rollers 25. A step S72 discriminates whether or not the transport path sensor 28 is ON. When the discrimination result in the step S72 becomes YES, a step S72 turns OFF the solenoid 46 so as to position the switch claw 24 to direct the recording sheet 2 towards the rollers 25, rotates the motor 50 in the forward direction and turns OFF the clutch which drives the duplex supply rollers 75, and the process advances to the step S41 shown in FIG. 12B.

Figure 16:
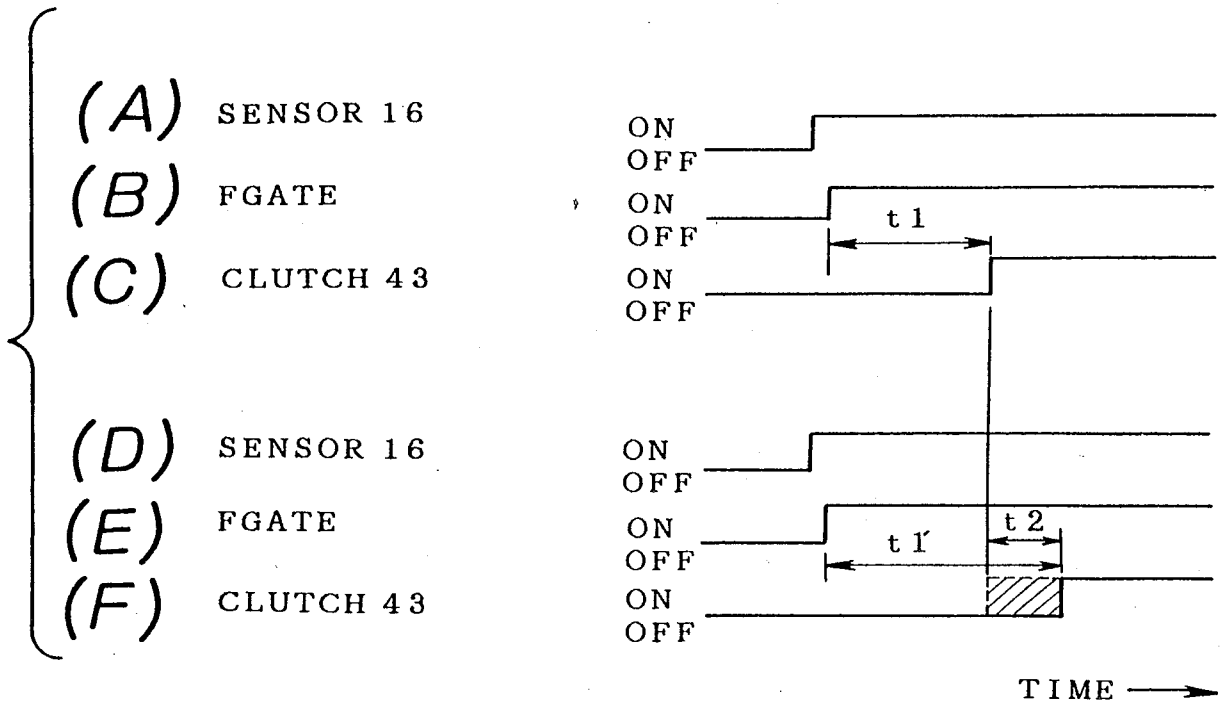
FIGS. 16(A) through 16(F) are timing charts for explaining an operation of a third embodiment of the image forming apparatus according to the present invention.

Next, a description will be given of a third embodiment of the image forming apparatus according to the present invention. The operating principle of this third embodiment will be described in conjunction with FIGS. 2 through 9. FIGS. 16(A) through 16(C) are timing charts for explaining the operation during the image recording on the first sides of the recording sheets 2, and FIGS. 16(D) through 16(F) are timing charts for explaining the operation during the image recording on the second sides of the recording sheets 2.

When the recording sheet 2 is supplied from the paper supplying device 1 and reaches the resist sensor 16, the resist sensor 16 turns ON as shown in FIG. 16(A) and the image write signal FGATE turns ON (that is, becomes active) responsive thereto as shown in FIG. 16(B). The electrostatic image is formed on the charged surface of the photosensitive body 4 when the image write signal FGATE turns ON. The clutch 43 turns ON after a time $t_1$ elapses from a time when the image write signal FGATE turns ON as shown in FIG. 16(A), so as to rotate the resist roller pair 3 and transport the recording sheet 2 towards the photosensitive body 4. The time $t_1$ is determined by $t_1=(l_2-l_2)/V$, where $l_1$ denotes a distance between the resist sensor 16 and the transfer charger 8, $l_2$ denotes a distance on the photosensitive body 4 between a laser beam irradiation part 100 shown in FIG. 3 and the transfer charger 8, and V denotes a linear velocity of the photosensitive body 4 which is identical to the linear velocity of the resist roller pair 3.

Figure 1:
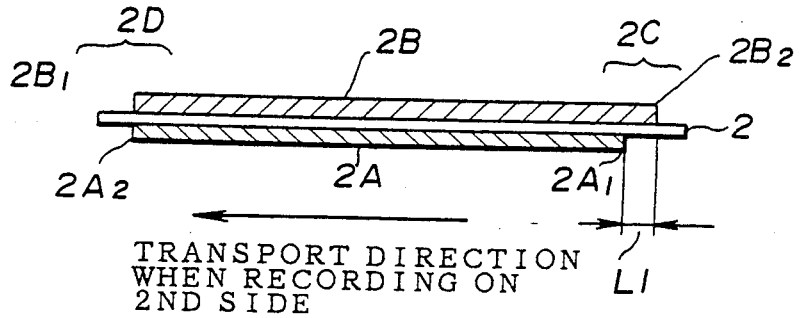
FIG. 1 PRIOR ART
FIG. 1 is a cross sectional view of a recording sheet for explaining a problem conventionally caused by a shrinkage of a recording paper when heated.
Figure 17:
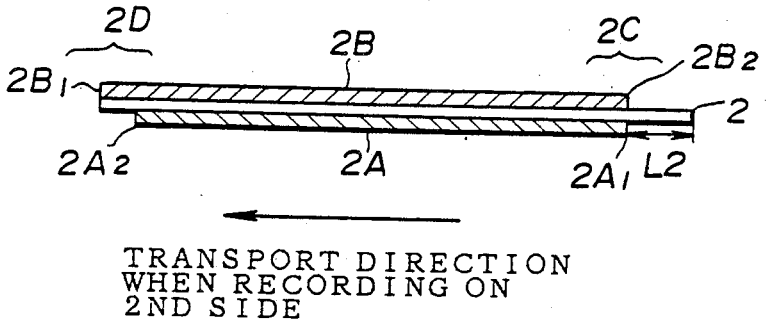
FIG. 17 is a cross sectional view of the recording sheet for explaining the effects of the third embodiment.
Figure 18:
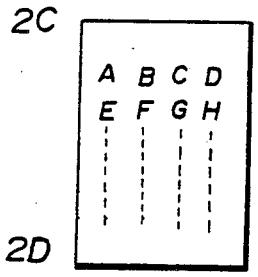
FIG. 18 is a plan view showing an image formed on the recording sheet.

As described before, the toner image transferred onto the recording sheet 2 which is transported to the photosensitive body 4 is fixed by the fixing unit 9. The recording sheet 2 is heated when subjected to the fixing in the fixing unit 9 and is slightly shrunk due to the heat. Hence, in this embodiment, the start of the transport of the recording sheet 2 is delayed when carrying out the image recording on the second sides of the recording sheets 2. In other words, a time $t_1'$ in FIG. 16(E) is set greater than the time $t_1$. As a result, the front end $2A_1$ of the image 2A on the first side of the recording sheet 2 and the rear end $2B_2$ of the image on the second side of the recording sheet 2 match at the end portions 2C as shown in FIG. 17. In other words, it is possible to match a distance L2 from the end of the recording sheet 2 to each of the images on the first and second sides of the recording sheet 2. Therefore, a margin (or space) of the same length can be formed as shown in FIG. 18 at the end portions on each of the first and second sides of the recording sheet 2.

The time $t_1'$ can be made variable depending on the time it takes from a time when the recording sheet 2 having the image recorded on the first side thereof passes the fixing part 9 and a time when the image recording is carried out on the second side of the recording sheet 2. By taking this measure, it is possible to match the positions of the images on the first and second sides of the recording sheet 2 even during the process in which the shrunk recording paper 2 expands back to the original state. In this case, a time t2 is variable in a range indicated by a hatching in FIG. 16(F), where $t2=t_1'-t_1$.

When matching the positions of the images on the first and second sides of the recording sheet 2 at the central portion of the recording sheet 2, $t_1'$ is set to $t_1+t_2/2$, where the value of $t_2$ takes different values depending on the size of the recording sheet 2.

In this embodiment, the front end $2A_1$ of the image 2A on the first side of the recording sheet 2 corresponds to the rear end $2B_2$ of the image 2B on the second side of the recording sheet 2 as shown in FIG. 17. It was described above that the recording sheet 2 shrinks due to the heat when passing the fixing unit 9, but the recording sheet 2 may expand depending on the circumstances. In this case, the resist roller pair 3 simply needs to be rotated with such a timing that the start of the transport of the recording sheet 2 is advanced when carrying out the image recording on the second sides of the recording sheets 2.

Figure 19:
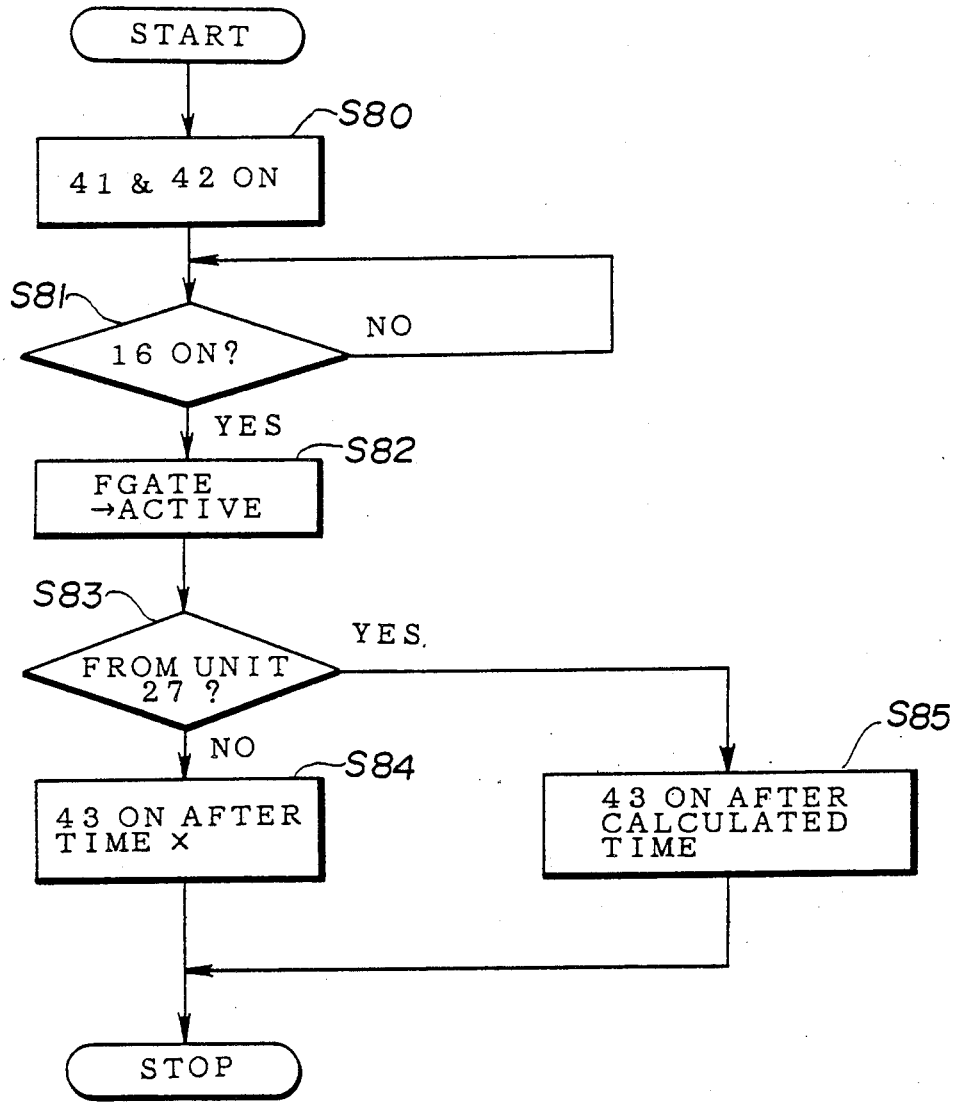
FIG. 19 is a flow chart for explaining an operation of the printer control part for the third embodiment.

Next, a description will be given of the operation of the printer control part 15 for the third embodiment described above by referring to FIG. 19. In FIG. 19, a step S80 turns ON the motor 41 and the clutch 42 so as to start supplying the recording sheet 2 from the paper supplying device 1. A step S81 discriminates whether or not the resist sensor 16 is ON. When the discrimination result in the step S81 becomes YES, a step S82 makes the image write signal FGATE active and a step S83 discriminates whether or not the recording sheet 2 is to be supplied from teh duplex unit 27. When the discrimination result in the step S83 is NO, a step S84 turns ON the clutch 43 after a predetermined time X elapses so as to match the front ends of the recording sheet 2 and the image. On the other hand, when the discrimination result in the step S83 is YES, a step S85 turns ON the clutch 43 after a predetermined time which is calculated from the predetermined time X and a variable time T which elapses from a time when the recording sheet 2 passes the paper eject sensor 40.

In the embodiments described heretofore, the recording sheet 2 is transported at a constant transport speed within the duplex unit 27 regardless of the size of the recording sheet 2. However, in order to further improve the efficiency or speed of the image recording, it is desirable that the transport speed of the recording sheet 2 is variable depending on the size of the recording sheet 2. Thus, a description will now be given of a fourth embodiment of the image forming apparatus according to the present invention in which the transport speed of the recording sheet 2 is variable depending on the size of the recording sheet 2.

Figure 20:
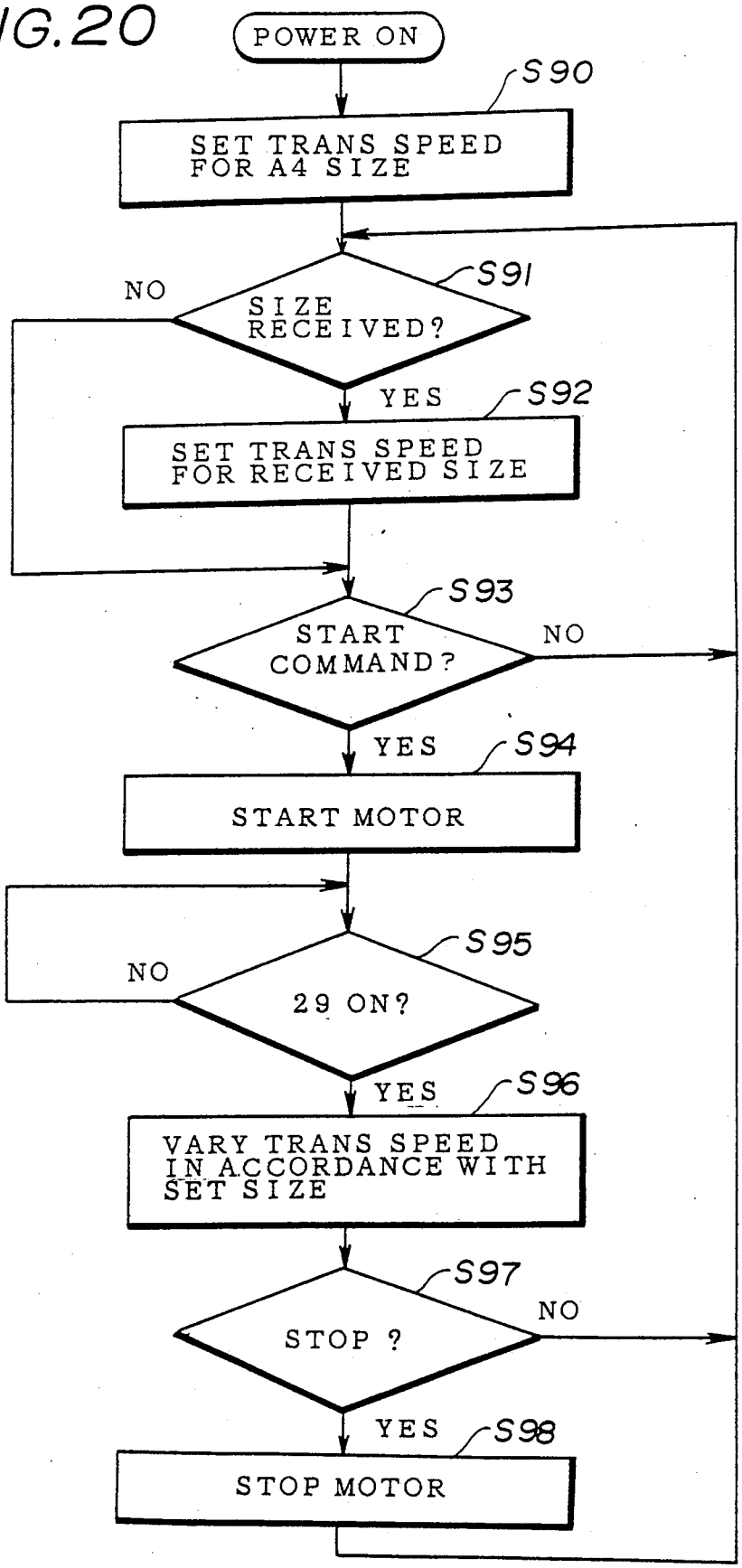
FIG. 20 is a flow chart for explaining an operation of the printer control part for a fourth embodiment of the image forming apparatus according to the present invention.

FIG. 20 shows a flow chart for explaining an operation of the printer control part 15 for this fourth embodiment. When the power source is turned ON, a step S90 sets the rotational speed of the motor 47 to set the transport speed of the recording sheet 2 to the transport speed for the A4 size recording sheet 2. A step S91 discriminates whether or not a paper size command is received from the host computer 60 or an operation panel (not shown) of the main printer body 10. When the discrimination result in the step S92 is YES, a step S92 sets the rotational speed of the motor 47 so that the transport speed of the recording sheet 2 corresponds to the paper size instructed by the paper size command. After the step S92 or when the discrimination result in the step S91 is NO, a step S93 discriminates whether or not a start command is received from the host computer 60 or the operation panel of the main printer body 10. The process returns to the step S91 when the discrimination result in the step S93 is NO.

On the other hand, when the discrimination result in the step S93 is YES, a step S94 sets the rotational speed of the motor 47 so that the transport speed of the recording sheet 2 within the duplex unit 27 becomes identical to that within the main printer body 10. Then, a step S95 discriminates whether or not the rear end of the recording sheet 2 is detected by the entrance sensor 29. When the discrimination result in the step S95 becomes YES, a step S96 changes the rotational speed of the motor 47 to the rotational speed set in the step S92 and changes the transport speed of the recording sheet 2 within the duplex unit 27. A step S97 discriminates whether or not a stop command is received from the host computer 60 or the operation panel of the main printer body 10. A step S98 stops the motor 47 when the discrimination result in the step S97 is YES. But after the step S98 or when the discrimination result in the step S97 is NO, the process returns to the step S91.

Further, the present invention is not limited to these embodiments, but various variations and modifications may be made without departing from the scope of the present invention.

What is claimed is:

1. A duplex unit for reversing a side of a recording sheet comprising:

a reversing part for successively reversing sides of incoming recording sheets and for outputting reversed recording sheets; and a stack part for stacking the reversed recording sheets from said reversing part in an arbitrary stack arrangement, said stack part including output means for successively outputting the reversed recording sheets within the arbitrary stack arrangement in a first-in-first-out sequence;

wherein said stack part has a plurality of transport paths for respectively holding one reversed recording sheet, said arbitrary stack arrangement being made up of the reversed recording sheets in said transport paths, said output means successively outputting the reversed recording sheets in said transport paths in an arbitrary sequence;

wherein said output means includes means for outputting the reversed recording sheets at a transport speed dependent on a size of each of the reversed recording sheets.

2. A duplex unit for reversing a side of a recording sheet comprising:

a reversing part for successively reversing sides of incoming recording sheets and for outputting reversed recording sheets; and a stack part for stacking the reversed recording sheets from said reversing part in an arbitrary stack arrangement, said stack part including output means for successively outputting the reversed recording sheets within the arbitrary stack arrangement in a first-in-first-out sequence;

wherein said stack part has a pair of transport paths for respectively holding one reversed recording sheet, said arbitrary stack arrangement being made up of the reversed recording sheets in said pair of transport paths, said output means alternately outputting the reversed recording sheets in said pair of transport paths.

3. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

wherein said stack part has a plurality of transport paths for respectively holding one reversed recording sheet, said arbitrary stack arrangement being made up of the reversed recording sheets in said transport paths, said output means successively outputting the reversed recording sheets in said transport paths in an arbitrary sequence;

wherein said output means includes means for outputting the reversed recording sheets at a transport speed dependent on a size of each of the reversed recording sheets.

4. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

wherein said stack part has a pair of transport paths for respectively holding one reversed recording sheet, said arbitrary stack arrangement being made up of the reversed recording sheets in said pair of transport paths, said output means alternately outputting the reversed recording sheets in said pair of transport paths.

5. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

wherein said stack part has a stacking tray on which the reversed recording sheets are stacked one on top of another to constitute said arbitrary stack arrangement, said output means successively outputting a reversed recording sheet which is at a bottom of said arbitrary stack arrangement;

wherein said output means includes means for outputting the reversed recording sheets at a transport speed dependent on a size of each of the reversed recording sheets.

6. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

wherein said feeding part includes means for feeding the recording sheet at different transport speeds between the first and second modes, so that a tip end of an image formed on a first side of one recording sheet coincides with a tip end of an image formed on a second side of said one recording sheet after a side reversal in said reversing part of said duplex unit.

7. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

wherein said feeding part includes a resist roller pair for feeding the reversed recording sheet from said switchback part with a timing delayed by a predetermined time with respect to a timing with which the recording sheet from said paper supplying device is fed to said recording part.

8. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

wherein said predetermined time is dependent on a quantity of shrinkage of the reversed recording sheet after an image is recorded on one side thereof and is selected to such a value that a tip end of an image formed on a first side of one recording sheet coincides with a tip end of an image formed on a second side of said one recording sheet after a side reversal in said reversing part of said duplex unit.

9. An image forming apparatus comprising:

a paper supplying device for successively supplying recording sheets;

a recording part for recording an image on the recording sheets by electrophotography;

a duplex unit including a reversing part for successively reversing sides of incoming recording sheets and for outputting reversed recording sheets, a stack part and a switchback part for successively supplying the reversed recording sheets;

a feeding part for feeding the recording sheets supplied from said paper supplying device in a first mode and for feeding the reversed recording sheets supplied from said duplex unit in a second mode; and an ejecting part for ejecting recording sheets recorded with images to said duplex unit in the first mode and to an outside of the image forming apparatus in the second mode, said stack part stacking the reversed recording sheets from said reversing part in an arbitrary stack arrangement and including output means for successively outputting the reversed recording sheets within the arbitrary stack arrangement in a first-in-first-out sequence;

which is coupled to a host computer which generates commands and image data of images to be recorded on the image forming apparatus, said image data being supplied to said recording part, said image forming apparatus further comprising control means for successively controlling an operation mode of the image forming apparatus to either one of the first and second modes responsive to the commands from the host computer for each of the recording sheets being supplied to said feeding part.

10. The image forming apparatus as claimed in claim 9 wherein said control means includes means for rearranging a sequence of the image data received from the host computer into a certain sequence before supplying the image data to said recording part.

11. The image forming apparatus as claimed in claim 10 wherein said certain sequence is dependent on a number of the recording sheets which is to be recorded with the images on both sides thereof.

12. A duplex unit for reversing a side of a recording sheet comprising:

a reversing part for successively reversing sides of incoming recording sheets and for outputting reversed recording sheets; and a stack part for stacking the reversed recording sheets from said reversing part in an arbitrary stack arrangement, said stack part including output means for successively outputting the reversed recording sheets within the arbitrary stack arrangement in a first-in-first-out sequence;

wherein said stack part has a stacking tray on which the reversed recording sheets are stacked one on top of another to constitute said arbitrary stack arrangement, said output means successively outputting a reversed recording sheet which is at a bottom of said arbitrary stack arrangement;

wherein said output means includes means for outputting the reversed recording sheets at a transport speed dependent on a size of each of the reversed recording sheets.

* * * * *